US005925488A

United States Patent [19]

Patel et al.

[11] Patent Number: 5,925,488

[45] **Date of Patent: *Jul. 20, 1999**

[54] TONER PROCESSES USING IN-SITU TRICALCIUM PHOSPATE

[75] Inventors: Raj D. Patel, Oakville, Canada; Grazyna E. Kmieckik-Lawrynowicz, Fairport, N.Y.; Anthony J. Paine; T. Hwee Ng, both of Mississauga, Canada

[73] Assignee: Xerox Corporation, Stamford, Conn.

[ * ] Notice: This patent is subject to a terminal disclaimer.

[21] Appl. No.: 08/972,380

[22] Filed: Nov. 18, 1997

Related U.S. Application Data

[63] Continuation of application No. 08/707,037, Sep. 3, 1996, Pat. No. 5,723,252.

[51] Int. Cl.[6] ..... G03G 9/08

[52] U.S. Cl. ..... 430/137; 430/111

[58] Field of Search ..... 430/137, 111

[56] References Cited

U.S. PATENT DOCUMENTS

| | | | |
|---|---|---|---|
| 4,797,339 | 1/1989 | Maruyama et al. | 430/137 |
| 4,996,127 | 2/1991 | Hasegawa et al. | 430/137 |
| 5,278,020 | 1/1994 | Grushkin et al. | 430/137 |
| 5,290,654 | 3/1994 | Sacripante et al. | 430/137 |
| 5,346,797 | 9/1994 | Kmiecik-Lawrynowicz et al. | 430/137 |
| 5,403,693 | 4/1995 | Patel et al. | 430/137 |
| 5,464,915 | 11/1995 | Ballova et al. | 526/225 |
| 5,565,296 | 10/1996 | Kmiecik-Lawrynowicz et al. | 430/137 |
| 5,723,252 | 3/1998 | Patel et al. | 430/137 |

*Primary Examiner*—Christopher D. Rodee
*Attorney, Agent, or Firm*—E. O. Palazzo

[57] ABSTRACT

A process for the preparation of toner which comprises (i) preparing a pigment dispersion comprised of a pigment dispersed in an ionic surfactant;

(ii) shearing said pigment dispersion with a latex or emulsion blend comprised of resin particles and a counterionic surfactant;

(iii) heating the above sheared blend below the glass transition temperature (Tg) of said resin particles to form electrostatically bound toner size aggregates;

(iv) adding a stabilizer of in situ tricalcium phosphate solid particulants generated from a solution of calcium chloride and trisodium phosphate;

(v) heating the mixture of (iii) and (iv) above about the Tg of the resin particles to obtain toner size particles comprised of resin and pigment;

(vi) washing with an acid to dissolve the trisodium phosphate; and (vii) optionally washing with water, and optionally drying the toner obtained.

7 Claims, No Drawings

TONER PROCESSES USING IN-SITU TRICALCIUM PHOSPATE

This application is a continuation of application Ser. No. 08/707,037, filed Sep. 3, 1996 U.S. Pat. No. 5,723,252.

BACKGROUND OF THE INVENTION

The present invention is generally directed to toner processes, and more specifically, to aggregation and coalescence processes for the preparation of toner compositions. In embodiments, the present invention is directed to the economical preparation of toners without the utilization of the known melt mixing, pulverization and/or classification methods, and wherein in embodiments toner compositions, or toner with an volume average diameter of from about 1 to about 25, and preferably from 1 to about 10 microns, and narrow GSD of, for example, from about 1.16 to about 1.26 as measured on the Coulter Counter can be obtained. The resulting toners can be selected for known electrophotographic imaging, printing processes, including color processes, and lithography. Specifically, with the processes of the present invention there is selected a stabilizer comprised of solid particulants, and more specifically, a submicron tricalcium phosphate particulant suspension in water is added after the aggregation of latex particles with the pigment particles, and prior to the coalescence of the toner aggregates, and wherein the particle size of the toner aggregates, and the GSD of the toner aggregates are retained over a wide range of temperatures, and wherein in embodiments there is enabled a process reduction time of from about 40 to about 75 percent. The present invention in embodiments is directed to a process for the preparation of toner particles comprising (i) preparing a pigment dispersion comprised of a pigment finely dispersed in a nonionic surfactant, an added ionic surfactant, preferably a cationic surfactant, and optionally other additives;

(ii) shearing the pigment dispersion with a latex or emulsion blend comprised of submicron resin particles, a counterionic surfactant, such as an anionic surfactant, and a nonionic surfactant using a high speed rotor-stator device such as a polytron;

(iii) heating the above sheared blend to a temperature below the glass transition temperature (Tg) of the resin to form electrostatically bound toner size aggregates with a narrow particle size distribution;

(iv) followed by adding a stabilizer preferably of in situ tricalcium phosphate solid particulants or particles preferably generated from an aqueous solution of calcium chloride and trisodium phosphate;

(v) heating the resulting mixture (iv) above the Tg of the resin to coalesce the aggregates to form toner particles comprised of resin, pigment and optional additives; followed by (vi) washing the toner particles with an acid, such as nitric acid, for example one molar nitric acid, or dilute nitric acid, to dissolve the tricalcium phosphate; and followed by (vii) washing with water and drying the said toner particles.

In embodiments, the present invention is directed to a process comprised of dispersing a pigment and optionally toner additives like a charge control agent or additive in an aqueous mixture containing an ionic surfactant, such as cationic surfactant, in amounts of from about 0.5 percent (weight percent throughout unless otherwise indicated) to about 10 percent, and shearing this mixture with a latex or emulsion mixture comprised of suspended submicron resin particles of from, for example, about 0.01 micron to about 1 micron in volume average diameter in an aqueous solution containing a counterionic surfactant, such as anionic surfactant in amounts of from about 1 percent to about 10 percent, and nonionic surfactant in amounts of from about 0.1 percent to about 5 percent, thereby causing a flocculation of resin particles, pigment particles and optional additives, such as CCA (charge control additive) or release agents, followed by heating at about 5 to about 40° C. below the resin Tg and preferably about 5 to about 15° C. below the resin Tg while stirring of the flocculent mixture which is believed to form statically bound aggregates of from about 1 micron to about 10 microns in volume average diameter, comprised of resin, pigment and optionally additives, adding a stabilizer of submicron in situ tricalcium phosphate (TCP) solid particulants suspended in water, and thereafter heating the TCP stabilized aggregates to a temperature above the Tg (glass transition temperature) of the resin. The size of the aforementioned statistically bonded aggregated particles can be further controlled by adjusting the temperature in the aggregation step. An increase in the temperature causes an increase in the size of the aggregated particle. This process of aggregating submicron latex and pigment particles is kinetically controlled, that is the temperature increases the process of aggregation. The higher the temperature during stirring, the quicker the aggregates are formed, for example from about 2 to about 10 times faster in embodiments, and the latex submicron particles are picked up more quickly. The temperature also controls in embodiments the particle size distribution of the aggregates, for example the higher the temperature the narrower the particle size distribution, and this narrower distribution can be achieved in, for example, from about 0.5 to about 24 hours and preferably in about 1 to about 3 hours time. Heating the mixture about above or in embodiments equal to the resin Tg generates toner particles with, for example, an average particle volume diameter of from about 1 to about 25 and preferably 10 microns. It is believed that during the heating stage, the components of aggregated particles fuse together to form composite toner particles. In another embodiment thereof, the present invention is directed to an in situ process comprised of first dispersing a dry or wet cake of pigment, such as HELIOGEN BLUE™, or HOSTAPERM PINK™, in an aqueous mixture containing a cationic surfactant, such as benzalkonium chloride (SANIZOL B-50™), utilizing a high shearing device, such as a Brinkmann Polytron, microfluidizer or sonicator or using a predispersed pigment comprised of submicron pigment particles stabilized by a nonionic dispersant or grinding aids, to which a cationic surfactant, such as benzalkonium chloride (SANIZOL B™), and water is added; thereafter, shearing such a mixture with a latex of suspended resin particles, such as poly(styrene butadiene acrylic acid), poly(styrene butylacrylate acrylic acid) or PLIOTONE™, a poly(styrene butadiene), and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate, for example NEOGEN R™ or NEOGEN SC™, and a nonionic surfactant such as alkyl phenoxy poly(ethylenoxy)ethanol, for example IGEPAL 897™ or ANTAROX 897™, using high shearing devices, thereby resulting in a flocculation, or heterocoagulation of the resin particles with the pigment particles; and which, on further stirring for about 1 to about 3 hours while heating, for example, from about 40 to about 50° C., results in the formation of electrostatically bound aggregates ranging in size of from about 0.5 micron to about 10 microns in average diameter size as measured by the Coulter Counter (Microsizer II), where the size of the aggregated particles and their distribution obtained is controlled by the addition of an aqueous suspension submicron in situ tricalcium phosphate (TCP) particulants during the subsequent coalescence where the temperature is raised to 5 to 50° C. above the resin Tg to provide particle fusion or coalescence of the polymer and pigment particles; followed by the addition of acid, such as nitric acid, to dissolve the TCP from the surface of the coalesced toner particle, followed by washing with water and drying whereby toner particles comprised of resin and pigment with various particle size diameters can be obtained, such as from 1 to about 15, and preferably in the range of 2 to 10 microns in average volume particle diameter. The aforementioned toners are especially useful for the development of colored images with excellent line and solid resolution, and wherein substantially no background deposits are present.

While not being desired to be limited by theory, it is believed that the flocculation or heterocoagulation is caused by the neutralization of the pigment mixture containing the pigment and ionic, such as cationic, surfactant absorbed on the pigment surface with the resin mixture containing the resin particles and anionic surfactant absorbed on the resin particle. The particle size obtained during the aggregation step, which comprises heating the mixture below the resin Tg, is controlled by temperature of the aggregation step. Tricalcium phosphate, for example, added at from about 5 to about 50° C. above the resin Tg fuses the aggregated particles or coalesces the particles to enable the formation of toner particles comprised of polymer, pigments and optional toner additives like charge control agents, and the like, such as waxes. Furthermore, in other embodiments the ionic surfactants can be exchanged such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and thereby forming statically bounded aggregate particles by stirring and heating below the resin Tg; and thereafter, that is when the aggregates are formed, heating above the resin Tg to form stable toner composite particles. The latex blend or emulsion is comprised of resin or polymer, counterionic surfactant, and nonionic surfactant. In the embodiments of the present invention, the amount of the submicron in situ tricalcium phosphate particulant stabilizer selected to retain the particle size and GSD from the aggregation step through the coalescence step is in the range of 0.1 to 5.0 weight percent by weight of the total reactor contents, and preferably in the range of 0.8 to 2.0 weight percent by weight of total reactor contents.

The process described in the present application has several advantages as indicated herein including in embodiments the effective preparation of small toner particles with narrow particle size distribution as a result of no classification; high toner yields; large amounts of power consumption are avoided; the process can be completed in rapid times, including shorter coalescence times; and the process is controllable since the particle size of the toner can be rigidly controlled by, for example, controlling the temperature of the aggregation.

Furthermore, the present invention is directed to the use of a solid particulate as a stabilizer to retain the particle size and the GSD of the aggregates comprised of resin and pigment particles and optional additives, which when heated 5 to 50° C. above the resin Tg, provide pigmented composite toner particles. The toners particles can be washed with dilute nitric acid to dissolve the TCP stabilizer, followed by 2 to 3 washes with water, compared to the 6 to 7 washes usually needed for the surfactant stabilized systems as described in U.S. Pat. No. 5,403,693, the disclosure of which is totally incorporated herein by reference. The present invention thus focuses on the use of solid particulate stabilizers in the aggregation coalescence steps wherein the stabilizer is introduced after the formation of the desired aggregate particle size and GSD, which aggregates are comprised of a resin and a pigment and optional additives, where the aggregates are then further heated to coalesce the aggregates resulting in composite particles, while retaining the particle size and the GSD. Furthermore, with the present invention in embodiments the amount of stabilizer selected is proportional to the particle size required, wherein the smaller the particle size, the greater the amount of the stabilizer. The pigment particles in the size range of about 0.05 to about 0.3 micron are dispersed in a cationic surfactant, and blended with the anionic latex particle, also in the size range of about 0.05 to about 0.3 micron at speeds of 500 to 10,000 rpm and preferably in the range of 1,000 to 5,000 rpm, followed by raising the temperature of the blend to about 5 to 15° C. below the resin Tg to form aggregates of pigment and resin in the size range of 2 to 10 microns with a narrow particle size distribution. There is then added an aqueous in situ submicron TCP particulate generated by mixing an aqueous solution of calcium chloride and trisodium phosphate at speeds of 3,000 to 10,000 rpms. The amount of TCP particulate selected is in the range of 0.1 to 5.0 weight percent based on total reactor contents, and preferably 0.8 to 2.3 weight percent.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide GSD. In U.S. Pat. No. 4,797,339, there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108 discloses a process for the preparation of a copolymer of styrene and butadiene by specific suspension polymerization. Other prior art that may be of interest includes U.S. Pat. Nos. 3,674,736; 4,137,188 and 5,066,560.

There is illustrated in U.S. Pat. No. 5,278,020, the disclosure of which is totally incorporated herein by reference, a process for the preparation of a toner composition comprising the steps of (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the nonpolar toner sized composite particles.

Emulsion/aggregation processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797.

SUMMARY OF THE INVENTION

It is an object of the present invention to provide toner processes with many of the advantages illustrated herein.

In another object of the present invention there are provided simple and economical processes for the direct preparation of black and colored toner particles with controlled particle size and narrow GSD.

Another object of the present invention resides in emulsion/aggregation processes for the preparation of toner particles and wherein submicron in situ tricalcium phosphate particles are added as a stabilizer prior to or during the toner coalescence, thereby enabling excellent toner particle sizes with narrow GSD, lower coalescence temperatures, and a reduction in process time. The addition of the submicron TCP particulates as a stabilizer offers several advantages including a process reduction time since the removal of the stabilizer can be easily accomplished by reacting it with a dilute acid, followed by simply washing twice with water, while the known surfactant stabilized system usually requires several water washes, reslurrying of the toner particles after each wash and a minimum mixing time (or contact time of fresh water with the toner particles), thus the prior art washing process is at least 4 times longer; the coalescence temperature can be at least 10 to 15° C. lower than the known surfactant stabilizer processes, thereby shortening the coalescence cycle time and increasing the reactor through put; and readily incorporating charge enhancers, such as silica, as stabilizers, and requiring a minimum number of washing steps upon completion of the coalescence step.

Moreover, in accordance with an object of the present invention, the ultrafine or submicron water insoluble phosphate stabilizing particles, such as, tricalcium phosphate, formed under high shear requires less aqueous acid to remove the suspending agent from the surface of the resin particle because of the lower concentration and high surface area of the suspending agent particles so that environmental problems related to the handling and disposal of large amounts of acid washings are thereby greatly reduced. In accordance with another object of the present invention, since no polymeric surfactants or polymeric suspending agents need to be used, no polymeric surfactant or polymeric suspending agent remains on the surface of the toner particles and thereby eliminates a possible source of humidity sensitivity and particle charge distortion.

In a further object of the present invention there is provided a process for the preparation of toner compositions with an average particle volume diameter of from between about 1 to about 20 microns, and preferably from about 2 to about 10 microns, and with a narrow GSD of from about 1.2 to about 1.3 and preferably from about 1.16 to about 1.25 as measured by a Coulter Counter.

In a further object of the present invention there is provided a process for the preparation of colored toner particles with controlled particle size with a narrow GSD by heating the aggregates comprised of submicron pigment and resin particles, above the resin Tg to temperature in the range of 5 to 35° C., for period of 0.5 to 3 hours, in the presence of submicron particulate stabilizer; optionally removing the particulate stabilizer with dilute acid wash, followed by water washes.

Moreover, in a further object of the present invention there is provided a process for the preparation of toner compositions which after fixing to paper substrates results in images with a gloss of from 20 GGU (Gardner Gloss Units) up to about 70 GGU as measured by Gardner Gloss meter matching of toner and paper.

Also, in accordance with an object of the present invention, the ultrafine or submicron water insoluble phosphate stabilizing particles, such as tricalcium phosphate, formed under high shear requires less aqueous acid to remove the suspending agent from the surface of the resin particle because of the lower concentration and high surface area of the suspending agent particles, thus environmental problems related to the handling and disposal of large amounts of acid washings are thereby greatly reduced. In accordance with another object of the present invention, since no polymeric surfactants or polymeric suspending agents are used, no polymeric surfactant or polymeric suspending agent remains on the surface of the toner particles thereby eliminating a possible source of humidity sensitivity and particle charge distortion.

In another object of the present invention there is provided a composite toner of polymeric resin with pigment and optional additives in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

In embodiments the present invention relates to a process for the preparation of toner which comprises (i) preparing or providing a pigment dispersion comprised of a pigment dispersed in an ionic surfactant;

(ii) shearing the pigment dispersion with a latex or emulsion blend comprised of submicron, for example less than about one micron, resin particles and a counterionic surfactant;

(iii) heating the above sheared blend below the glass transition temperature (Tg) of the resin to form electrostatically bound toner size aggregates;

(iv) adding a stabilizer of in situ tricalcium phosphate (TCP) solid particulants generated from a solution of calcium chloride and trisodium phosphate;

(v) heating the mixture of (iii) and (iv) above about the Tg of the resin to obtain toner size particles comprised of resin and pigment;

(vi) washing with an acid to dissolve the TCP; and (vii) washing with water and drying the toner obtained.

In embodiments, the present invention is directed to a process for the preparation of toner compositions, which comprises initially attaining or generating an ionic pigment dispersion, for example dispersing an aqueous mixture of a pigment or pigments, such as carbon black like REGAL 330®, phthalocyanine, quinacridone or RHODAMINE B™ type with a cationic surfactant, such as benzalkonium chloride, by utilizing a high shearing device, such as a Brinkmann Polytron, thereafter shearing this mixture by utilizing a high shearing device, such as a Brinkmann Polytron, with a suspended resin mixture comprised of polymer components, such as poly(styrene butadiene) or poly(styrene butylacrylate); and wherein the particle size of the suspended resin mixture is, for example, from about 0.01 to about 0.5 micron in an aqueous surfactant mixture containing an anionic surfactant, such as sodium dodecylbenzene sulfonate and nonionic surfactant; resulting in a flocculation, or heterocoagulation of submicron resin particles with submicron pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below about the resin Tg, for example from about 5 to about 15° C., and allowing the formation of electrostatically stabilized aggregates ranging from about 0.5 micron to about 10 microns in volume average diameter throughout unless ohterwise indicated; thereafter adding an aqueous submicron tricalcium phosphate particulate stabilizer, followed by heating above about the resin Tg, for example from about 5 to about 35° C., to cause coalescence of the latex, and pigment particles, which heating is for a period of 30 to 90 minutes, and followed by washing with dilute acid, followed by washing with water to remove the residual stabilize, and drying such as by use of an Aeromatic fluid bed dryer, freeze dryer, or spray dryer; and whereby toner particles comprised of resin pigment, and optional additive with various particle size diameters can be obtained, such as from about 2 to about 10 microns in average volume particle diameter as measured by the Coulter Counter. The amount of stabilizer selected can vary, however in embodiments this amount is from about 0.1 to about 5, preferably from about 0.8 to 2.3 weight percent based on the total reactor contents of resin, pigment, surfactants and water.

In the embodiments that follow there is added the tricalcium phosphate stabilizer preferably prior to, or during the coalescence, and which stabilizer is preferably added in an amount of 0.8 to 2.3 percent by weight. Also in embodiments, the stabilizer may be removed after the toner product is obtained, and wherein removal can be accomplished by washing.

Embodiments of the present invention include a process for the preparation of toner compositions comprised of resin and pigment comprising (i) preparing a pigment dispersion comprised of a pigment finely dispersed in a nonionic surfactant to which is added an ionic surfactant, preferably a cationic surfactant, and optional additives;

(ii) shearing the pigment dispersion with a latex mixture comprised of submicron resin particles in water and counterionic surfactant, such as an anionic surfactant, and a nonionic surfactant;

(iii) heating the resulting homogenized mixture below the resin Tg at a temperature of from about 35 to about 50° C. (or 5 to 15° C. below the resin Tg) thereby causing flocculation or heterocoagulation of the formed particles of pigment, resin and optional additives to form electrostatically bounded toner size aggregates;

(iv) followed by the addition of in situ submicron tricalcium phosphate solid particulate generated from an aqueous solution of calcium chloride and trisodium phosphate;

(v) heating to, for example, from about 60 to about 95° C. the statically bound aggregated particles of (iv) to form the toner particles comprised of polymeric resin and pigment; and (vi) followed by washing with a dilute acid, and by washing with water and drying of the toner particles.

Also, in embodiments the present invention is directed to processes for the preparation of toner compositions which comprise (i) preparing an ionic pigment mixture by dispersing a pigment, such as carbon black like REGAL 330®, HOSTAPERM PINK™, or PV FAST BLUE™, of from about 2 to about 10 percent by weight of toner in an aqueous mixture containing a cationic surfactant, such as dialkylbenzene dialkylammonium chloride like SANIZOL B-50T™ available from Kao or MIRAPOL™ available from Alkaril Chemicals, and from about 0.5 to about 2 percent by weight of water utilizing a high shearing device, such as a Brinkmann Polytron or IKA homogenizer, at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE™ or poly(styrene-butadiene), and which resin particles are present in various effective amounts, such as from about 40 percent to about 98 percent by weight of the toner, and wherein the polymer resin latex particle size is from about 0.1 micron to about 3 microns in volume average diameter, and counterionic surfactant, such as an anionic surfactant like sodium dodecylsulfate, dodecylbenzene sulfonate or NEOGEN R™, from about 0.5 to about 2 percent by weight of water, a nonionic surfactant, such as polyethylene glycol or polyoxyethylene glycol nonyl phenyl ether or IGEPAL 897™ obtained from GAF Chemical Company, from about 0.5 to about 3 percent by weight of water, thereby causing a flocculation or heterocoagulation of pigment, charge control additive and resin particles; (iii) diluting the mixture with water to enable from about 50 percent to about 15 percent of solids; (iv) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further, stirring with a mechanical stirrer from about 250 to 500 rpm about below the resin Tg at, for example, about 5 to 1 5° C. below the resin Tg at temperatures of about 35 to 50° C. to form electrostatically stable aggregates of from about 0.5 micron to about 5 microns in average volume diameter; (v) adding aqueous submicron tricalcium phosphate particulate stabilizer in the range of 0.1 to 5 percent by weight to stabilize the aggregates formed in (iv), heating the statically bound aggregate composite particles at from about 60° C. to about 95° C. for a duration of about 30 minutes to about 180 minutes to form toner sized particles of from about 3 microns to about 7 microns in volume average diameter and with a geometric size distribution of from about 1.2 to about 1.3 as measured by the Coulter Counter; (vi) washing with dilute acids followed by water washes; and (vii) isolating the toner sized particles by washing, filtering and drying thereby providing composite toner particles comprised of resin and pigment. Flow additives to improve flow characteristics and charge additives, if not initially present, to improve charging characteristics may then be added by blending with the formed toner, such additives including AEROSILS® or silicas, metal oxides like tin, titanium and the like, metal salts of fatty acids, like zinc stearate, and which additives are present in various effective amounts, such as from about 0.1 to about 10 percent by weight of the toner. The continuous stirring in step (iii) can be accomplished as indicated herein, and generally can be effected at from about 200 to about 1,000 rpm for from about 1 hour to about 24 hours, and preferably from about 12 to about 6 hours.

One preferred method of obtaining the pigment dispersion depends on the form of the pigment utilized. In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents such as the aforementioned ionic or nonionic surfactants.

Embodiments of the present invention include a process for the preparation of toner compositions with controlled particle size comprising (i) preparing a pigment dispersion in water, which dispersion is comprised of a pigment of a diameter of from about 0.01 to about 0.5 microns in volume average diameter, an ionic surfactant, such as a cationic, and optional additives, such as charge control agents or release agents;

(ii) shearing the pigment dispersion with a latex blend comprised of resin particles of submicron size of from about 0.01 to about 0.5 micron in volume average diameter, a counterionic surfactant such as an anionic surfactant, and a nonionic surfactant thereby causing a flocculation or heterocoagulation of the formed particles of pigment, resin and optional additives to form a uniform dispersion of solids in the water and surfactant system;

(iii) heating the above sheared blend at a temperature of from about 5 to about 15° C. below the Tg of the resin particles while continuously stirring to form electrostatically bound or attached relatively stable (for Coulter Counter measurements) toner size aggregates with a narrow particle size distribution;

(iv) followed by the addition of aqueous submicron tricalcium phosphate particulate stabilizer generated in an in situ manner from aqueous calcium chloride and trisodium phosphate using a high shearing device such as a polytron operating at speeds of 5,000 to 15,000 rpm;

(v) heating and coalescing the statically bound aggregated particles at a temperature of from about 5 to about 35° C. above the Tg of the resin to provide mechanically stable toner particles comprised of polymeric resin, pigment and optional additives;

(vi) washing the toner particles with an acid, followed by water washes;

(vii) separating the toner particles from the water by filtration; and (viii) drying the said toner particles.

In embodiments, the heating in (iii) is accomplished at a temperature of from about 29 to about 59° C.; the resin Tg in (iii) is from about 50 to about 80° C.; heating in (v) is from about 5 to about 50° C. above the Tg; and wherein the resin Tg in (v) is from about 50 to about 80° C.

In embodiments, heating below the glass transition temperature (Tg) can include heating at about the glass transition temperature or slightly higher. Heating above the Tg can include heating at about the Tg or slightly below the Tg in embodiments.

Embodiments of the present invention also include selecting the ionic surfactant in the pigment dispersion step, such as a cationic surfactant, and the counterionic surfactant selected for the latex synthesis, such as an anionic surfactant, can be interchanged.

Toner and developer compositions thereof are also encompassed by the present invention in embodiments.

Illustrative examples of specific resin particles, resins or polymers selected for the process of the present invention include known polymers, such as poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methyl methacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly (styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™, a polyester resin, (Reichhold Chemical Inc.), PLASTHALL™, a polyester, (Rohm & Hass), CYGLAS™, a polyester molding compound (American Cyanamide), ARMCO™, a polyester, (Armco Composites), CELANEX™, a glass reinforced thermoplastic polyester, (Celanese Eng), RYNITE™, a thermoplastic polyester, (DuPont), STYPOL™, a polyester with styrene monomer (Freeman Chemical Corporation), and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional, and such groups can be present in various amounts of from about 0.1 to about 10 percent by weight of the polymer resin. Known chain transfer agents, for example dodecanethiol, about 1 to about 10 percent, or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites M08029, M08060; Columbian magnetites; MAPICO BLACKS™ and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like. As colored pigments, there can be selected cyan, magenta, yellow, red, green, brown, blue or mixtures thereof. Specific examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, CINQUASIA MAGENTA available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants, such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897 ™. An effective concentration of the nonionic surfactant is in embodiments, for example, from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecylbenzyl triethyl ammonium chloride, MIRAPOL and ALKAQUAT available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Examples of particulates added to the aggregated particles to retain the particle size and GSD can be selected from a group of oxides, hydroxides, carbonates, bicarbonates, sulfates, and phosphates of calcium, magnesium, tin, sodium, alumina and other metals.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The tricalcium phosphate selected (TCP) can be generated by preparing an aqueous solution containing 45.3 grams of calcium chloride in 300 grams of water, which is then blended with an aqueous solution of sodium phosphate containing 78.6 grams of sodium phosphate in 300 grams of water, using a high shear devic,e such as a polytron, at speeds of 5,000 to 15,000 rpm to generate submicron TCP particulates. The in situ TCP synthesis is illustrated by the following equation:

$$2Na_3PO_4.10H_2O + 3CaCl_2.2H_2O \rightarrow Ca_3(PO_4)_2 + 6NaCl + 30H_2O$$

$$X\,Ca_3(PO_4)2 = \frac{\text{Wt. of trisodium phosphate} \times 310}{760}$$

Of importance in embodiments is the need for the particulates to be in the size range of from about 0.1 to about 1.0 micron to enable more effective stabilization, and a minimum amount of stabilizer, for example in the range of 0.8 to 2.3 percent by weight.

The following Examples are being submitted to further define various species of the present invention. These Examples are intended to be illustrative only and are not intended to limit the scope of the present invention. Also, parts and percentages are by weight unless otherwise indicated.

EXAMPLE I

Preparation of Latex:

A polymeric or emulsion latex was prepared by the emulsion polymerization of styrene/butylacrylate/acrylic acid (82/18/2 parts) in nonionic/anionic surfactant solution (3.0 percent) as follows. 656 Grams of styrene, 144 grams of butyl acrylate, 16 grams of acrylic acid, 24 grams of dodecanethiol, and 8 grams of carbon tetrabromide were mixed with 1,200 milliliters of deionized water in which 18 grams of sodium dodecyl benzene sulfonate anionic surfactant (NEOGEN RT™ which contains 60 percent of active component), 17.2 grams of polyoxyethylene nonyl phenyl ether-nonionic surfactant (ANTAROX 897™), and 8 grams of ammonium persulfate initiator were dissolved. The emulsion was then polymerized at 70° C. for 8 hours. The resulting latex was comprised of 60 percent water and 40 percent (weight percent throughout) solids of a copolymer of polystyrene/polybutyl acrylate/polyacrylic acid, 82/18/2; the Tg of the latex dry sample was 55.1° C., as measured on a DuPont DSC; $M_w$=24,600, and $M_n$=1,200 as determined on the Hewlett Packard GPC. The zeta potential as measured on the Pen Kem Inc. Laser Zee Meter was −80 millivolts for the polymeric latex. The particle size of the latex as measured on Brookhaven BI-90 Particle Nanosizer was 147 nanometers. The aforementioned latex was then selected for the following toner preparations.

EXAMPLE II

Preparation of Toner Particles:

260 Grams of the above latex (40 percent solids) were simultaneously added with a pigment dispersion comprised of 7.6 grams of SUNSPERSE CYAN 15:3 (53.4 percent solids), 2.3 grams of a cationic surfactant (SANIZOL B™), and 240 grams of water to 400 grams of water while shearing at 5,000 rpms for a period of 3 minutes using a high speed rotator-stator device such as IKA polytron. The mixture was then transferred into a reaction kettle and heated to a temperature of 45° C. in order to perform aggregation while being stirred with a mechanical stirrer. The aggregation was performed for a period of 2 to 4 hours while the particles size and the particle size distribution were monitored.

78.6 Grams of sodium phosphate were dissolved in 300 grams of water. In a separate beaker, 45.3 grams of calcium chloride were dissolved in 300 grams of water. 200 Grams of each of the above solutions were added simultaneously to 200 grams of water, while being sheared at speeds of 12,000 rpm. This shearing was accomplished since the viscosity resulting from the in situ formation of tricalcium phosphate (TCP) particulates needs to be broken down into submicron size in order to be more effective as a stabilizer. The amount of in situ TCP generated in this Example was 21.3 grams.

After 3 hours at 45° C., the aggregate particle size measured was 5.8 microns in volume average diameter with a GSD of 1.18. The above aqueous in situ TCP particulate solution was then added to the reaction kettle and its temperature raised to 90° C. to coalesce the aggregate particles. Particle size measurement after 2 hours indicated a size of 6.0 microns with a GSD of 1.20. The particles were then cooled down to room temperature, about 25° C., and 60 milliliters of 10 N nitric acid were added, followed by stirring for a period of 45 minutes to dissolve the TCP. The mixture was then filtered and then reslurried in 1 liter of water, and stirred for a period of 30 minutes before filtering. The process of reslurrying, stirring and filtering was repeated, followed by drying of the particles by freeze drying. The toner triboelectrical charge as measured by a Faraday Cage was −16 μc/gram.

EXAMPLE III

260 Grams of the above latex (40 percent solids) were simultaneously added with a pigment dispersion comprised of 7.6 grams of SUNSPERSE CYAN (53.4 percent solids), 2.3 grams of a cationic surfactant (SANIZOL B™), and 240 grams of water to 400 grams of water while shearing at 5,000 rpms for a period of 3 minutes using a high speed rotator-stator device such as IKA polytron. The mixture was then transferred into a reaction kettle and heated to a temperature of 45° C. in order to perform the aggregation while being stirred with a mechanical stirrer. The aggregation was performed for a period of 2 to 4 hours while the particle size and the particle size distribution were monitored.

78.6 Grams of sodium phosphate were dissolved in 300 grams of water. In a separate beaker, 45.3 grams of calcium chloride were dissolved in 300 grams of water. 200 Grams of each of the above solutions were added simultaneously to 200 grams of water, while being sheared at speeds of 12,000 rpm. This shearing was necessary, since the viscosity resulting from the in situ formation of tricalcium phosphate (TCP) particulates needs to be to be broken down into submicron size in order to be effective as a stabilizer. The amount of in situ TCP generated in this Example was 21.3 grams After 3 hours at 45° C., the prepared aggregate particle size measured was 6.5 microns with a GSD of 1.18. The above aqueous in situ TCP particulate solution was then added to the reaction kettle and the temperature raised to 90° C. to coalesce the aggregate particles. Particle size measurement after 2 hours indicated a size of 6.8 microns with a GSD of 1.18. The particles were then cooled down to room temperature, about 25° C., and 60 milliliters of 10 N nitric acid were added and stirred for a period of 45 minutes to dissolve the TCP. The mixture was then filtered and then reslurried in 1 liter of water, and stirred for a period of 30 minutes before filtering. The process of reslurrying, stirring and filtering was repeated followed by drying of the toner particles by freeze drying. The toner triboelectrical charge was in the range of −13 μc/gram.

EXAMPLE IV

260 Grams of the above latex (40 percent solids) were simultaneously added with a pigment dispersion comprised of 7.6 grams of SUNSPERSE CYAN (53.4 percent solids), 2.3 grams of a cationic surfactant (SANIZOL B™), and 240 grams of water to 400 grams of water while shearing at 5,000 rpms for a period of 3 minutes using a high speed rotator-stator device such as IKA polytron. The mixture was then transferred into a reaction kettle and heated to a temperature of 45° C. in order to perform the aggregation while being stirred with a mechanical stirrer. The aggregation was performed for a period of 2 to 4 hours while the particle size and the particle size distribution were monitored.

78.6 Grams of sodium phosphate (TCP) were dissolved in 300 grams of water. In a separate beaker, 45.3 grams of calcium chloride were dissolved in 300 grams of water. 200 Grams of each of the above solutions were added simultaneously to 200 grams of water, while being sheared at speeds of 12,000 rpm. This shearing was accomplished once the viscosity resulting from the in situ formation of tricalcium phosphate (TCP) particulates needs to be broken down into submicron size in order to be effective as a stabilizer. The amount of in situ TCP generated in this case was 21.3 grams.

After 2 hours at 50° C., the aggregate particle size measured was 6.3 microns with a GSD of 1.17. The above prepared aqueous in situ TCP particulate solution was then added to the reaction kettle and the temperature raised to 90° C. to coalesce the aggregate particles. Particle size measurement after 2 hours indicated a size of 6.4 microns with a GSD of 1.19. The particles were then cooled down to room temperature and 60 milliliters of 10 N nitric acid were added and stirred for a period of 45 minutes to dissolve the TCP. The mixture was then filtered and then reslurried in 1 liter of water, and stirred for a period of 30 minutes before filtering. The process of reslurrying, stirring and filtering was repeated three times followed by drying of the toner particles by freeze drying. The toner triboelectrical charge was in the range −14 μc/gram.

EXAMPLE V

260 Grams of the above latex (40 percent solids) were simultaneously added with a pigment dispersion comprised of 7.6 grams of SUNSPERSE CYAN (53.4 percent solids), 2.3 grams of a cationic surfactant (SANIZOL B™), and 240 grams of water to 400 grams of water while shearing at 5,000 rpms for a period of 3 minutes using a high speed rotator-stator device such as IKA polytron. The mixture was then transferred into a reaction kettle and heated to a temperature of 45° C. in order to perform the aggregation while being stirred with a mechanical stirrer. The aggregation was performed for a period of 2 to 4 hours while the particle size and the particle size distribution were monitored.

39.3 Grams of sodium phosphate were dissolved in 150 grams of water (Solution A). In a separate beaker, 22.65 grams of calcium chloride were dissolved in 150 grams of water (Solution B). Each of the above solutions were added simultaneously to 200 grams of water, while being sheared at speeds of 12,000 rpm. This shearing was necessary since the viscosity resulting from the in situ formation of tricalcium phosphate (TCP) particulates needs to be broken down into submicron size in order to be effective as a stabilizer. The amount of in situ TCP generated in this case was 16.0 grams.

After 1.75 hours at 50° C., the aggregate particle size measured was 6.3 microns with a GSD of 1.17. The above aqueous in situ TCP particulate solution was then added to the reaction kettle and the temperature raised to 90° C. in order to coalesce the aggregate particles. Particle size measurement after 2 hours indicated a size of 6.4 microns with a GSD of 1.19. The toner particles were then cooled down to room temperature and 60 milliliters of 10 N nitric acid were added and stirred for a period of 45 minutes to dissolve the TCP. The mixture was then filtered and then reslurried in 1 liter of water, and stirred for a period of 30 minutes before filtering. The process of reslurrying, stirring and filtering was repeated twice followed by drying of the particles by freeze drying. The toner triboelectrical was in the range −14 μc/gram.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A process for the preparation of toner which consists essentially of mixing a colorant dispersion and a latex, wherein said colorant dispersion is comprised of colorant and ionic surfactant, and said latex is comprised of resin and counterionic surfactant; heating below the resin Tg temperature; adding in situ tricalcium phosphate; heating above the resin Tg, followed by optionally washing with water, and optionally drying said toner.

2. A process in accordance with claim 1 wherein the amount of tricalcium phosphate (TCP) selected is about 0.1 to about 5.0 weight percent based on the weight percent of all components selected.

3. A process in accordance with claim 1 wherein the in situ tricalcium phosphate is in the form of solid particles having a size of from about 0.2 to 0.8 micron volume average diameter.

4. A process in accordance with claim 1 wherein the resin is selected from the group consisting of poly(styrene-butadiene), poly(para-methyl styrene-butadiene), poly (meta-methylstyrene-butadiene), poly(alpha-methylstyrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methylstyrene-isoprene), poly (alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene).

5. A process in accordance with claim 1 wherein there results said toner composition with a volume average diameter of from about 1 to about 10 microns.

6. A process in accordance with claim 1 wherein said in situ tricalcium phosphate is in a solid form and is present in an amount of 0.8 to 2.3 percent by weight.

7. A process in accordance with claim 6 wherein said colorant is a pigment.

* * * * *